United States Patent [19]

Lemelson

[11] 4,075,799

[45] Feb. 28, 1978

[54] BUILDING INSULATION SYSTEM AND METHOD

[76] Inventor: Jerome H. Lemelson, 85 Rector St., Metuchen, N.J. 08840

[21] Appl. No.: 718,930

[22] Filed: Aug. 30, 1976

[51] Int. Cl.[2] ..... E02D 27/32; E04B 1/64; E04B 1/76

[52] U.S. Cl. ..... 52/169.5; 52/169.11

[58] Field of Search ..... 52/169.5, 169.11, 742

[56] References Cited

U.S. PATENT DOCUMENTS

| | | | |
|---|---|---|---|
| 2,604,268 | 7/1952 | Skagerberg | 52/169.5 X |
| 3,153,912 | 10/1964 | Retz | 52/169.11 X |
| 3,304,672 | 2/1967 | Bakke | 52/169.5 |
| 3,543,459 | 12/1970 | Mills | 52/169.11 |
| 3,858,371 | 1/1975 | Averill | 52/169.6 X |

FOREIGN PATENT DOCUMENTS

| | | | |
|---|---|---|---|
| 776,617 | 11/1934 | France | 52/196.6 |

*Primary Examiner*—Alfred C. Perham

[57] ABSTRACT

A method of insulating a building and constructional details of the insulating means are provided to prevent the loss of heat to the ground during winter months. A volume of ground surrounding the walls of the basement of a building is excavated of soil either during or after the setting of the basement walls and is rendered better heat insulating than the soil either by filling same with insulating material or partially filling same in a manner such that the non-filled air volumes between the insulation will not be subject to air convection of such a nature as to reduce the effect of the insulation. In certain instances, the material disposed in the volume surrounding the basement of the building or a portion thereof may serve as a heat storage sink for storing heat in a gas, liquid and/or solid material wherein radiation and/or one or more heat pumps with input from below the frost line are provided. During the summer, the same or auxiliary heat sink material may be cooled and employed in a cooling system.

20 Claims, 2 Drawing Figures

BUILDING INSULATION SYSTEM AND METHOD

SUMMARY OF THE INVENTION

Figure 1:
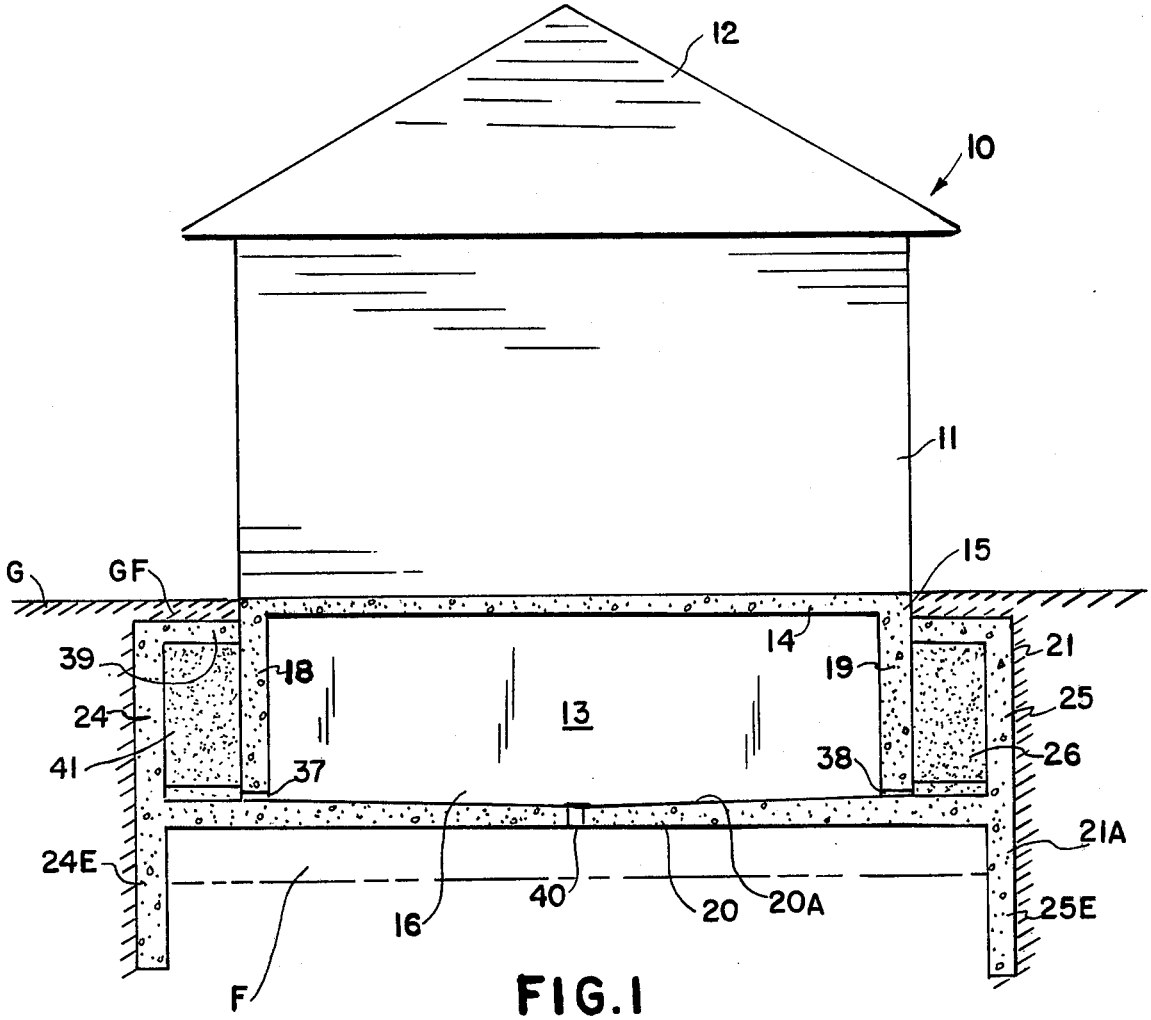

This invention relates to a method of insulating buildings and in particular to a building insulation method employing insulation of a volume outside of and surrounding the cellar or basement walls of the building.

Conventional techniques for insulating buildings against heat loss during winter time have been directed toward insulating the side walls and roof of the building from heat loss however, substantially little effort has been made to properly insulate the walls of the basements of buildings. Since most buildings, particularly homes and other forms of dwellings are heated by furnaces and oil burners which are disposed in the basements thereof and a substantial amount of heat is given off by such heating devices to the air volume within the basement by convection, substantial heat losses are sustained through the basement walls to the surrounding soil particularly if such basement walls are conventionally constructed of cement or brick materials.

The instant invention is directed toward improvements in the construction and arrangements of foundation materials for buildings, such as dwellings having basements in which heat for heating the buildings is generated although similar constructions or modifications thereto may be employed to prevent the loss of heat from the walls of buildings without basements wherein such walls extend below the level of the ground.

Accordingly, it is a primary object of this invention to provide new and improved structures in foundations and basements for buildings which are designed to minimize heat loss to the soil surrounding the foundations or basements.

Another object is to provide an insulating system for preventing the loss of heat from buildings to the ground or soil on which they are disposed by providing a volume surrounding the main foundation walls or basement wall of the building which volume not only contains an insulating material completely or partly filling same but is also structured to prevent the circulation of air therethrough to permit air trapped within the volume to serve as insulation at relatively low cost.

Another object is to provide an insulation system for the basement or foundation of a building, which system does not employ costly insulation material yet is highly effective in reducing heat loss from the building to the surrounding soil.

Another object is to provide an architectural structure in a building basement or foundation wherein a plenum is provided surrounding the walls of the basement of the building below ground level and serves a plurality of functions including a storage volume for insulation against heat loss and for containing a heat sink material for storing either or both a cold and hot fluid for use in either or both the functions of cooling and heating the building to maintain a desired temperature therein.

Another object is to provide a new and improved structure in a building basement or cellar situated below the ground wherein an insulating plenum is constructed with concrete walls around the basement wall and either the plenum outer wall or the basement side wall extends delow the floor level of the basement a degree to prevent ground water from flowing into the fill or soil beneath the basement and the basement flooring.

Another object is to provide an effective low cost means requiring little maintenance for insulating the cellar or basement of a building such as a family dwelling.

With the above and such other objects in view as will hereinafter more fully appear, the invention consists of the novel constructions, combinations and arrangements of parts as will be more fully described and illustrated in the accompanying drawings but it is to be understood that changes, variations and modifications may be resorted to which fall within the scope of the invention as claimed.

Figure 2:
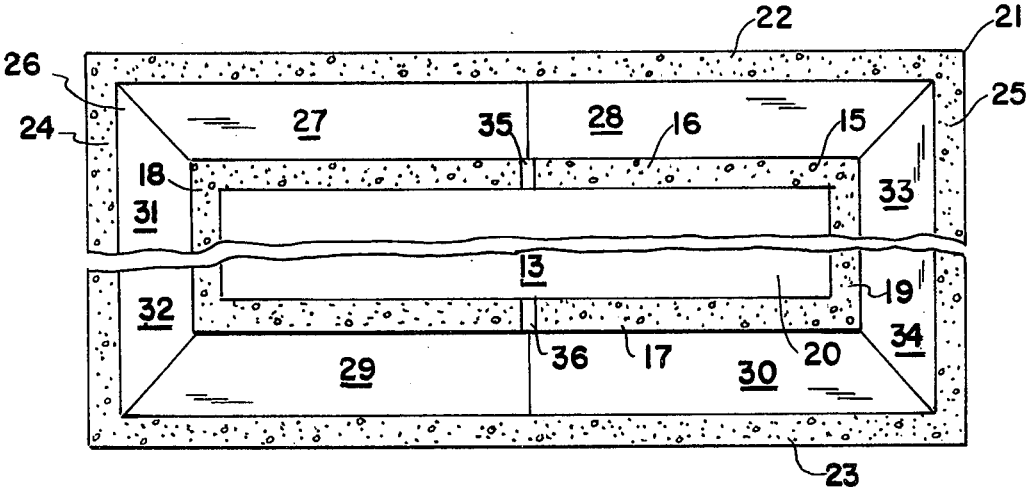

In the drawings:

FIG. 1 is a side view of a building, such as a house, having its foundation and cellar portions illustrated in cross-section; and FIG. 2 is a plan view in cross-section of respective end portions of the cellar and auxiliary wall portion of the foundation of the building of FIG. 1.

FIGS. 1 and 2 illustrate details of a typical building structure, particularly the cellar and foundation portions thereof with surrounding auxiliary wall portions defining the instant invention. The house or building 10 comprises a structural assembly which includes living quarters extending above the ground and housed within a rectangular wall structure 11 having a slanting roof 12 constructed on and extending upwardly therefrom. The above-ground structure 11 may have any suitable configuration and may be a single or multiple story building.

Subtending downwardly from structure 11 below ground level G is a cellar and insulation structure surrounding a cellar or basement volume 13 of any suitable configuration and formed with a ceiling portion 14 and a floor portion 20 which are illustrated as being cast of concrete although either or both may be formed of any suitable constructional material. The cellar or basement is defined by a circumscribing wall 15 which, in the construction illustrated in FIGS. 1 and 2, is composed of rectangularly joined vertical flat parallel side wall portions 16 and 17 connected to parallel end wall portions 18 and 19. Suitable supporting vertical and horizontal beams may extend between the side and end walls of the circumscribing wall 15 as well as between the floor and ceiling thereof.

Extending a distance outwardly from the vertical cellar wall 15 and circumscribing same is a vertical wall assembly 21 composed of parallel flat side wall portions 22 and 23 which are joined by flat end wall portions 24 and 25. A circumscribing parallel top wall 39 extends between the upper end of the circumscribing side wall 21 and is attached to the complete side wall 15 a short distance beneath the ground level G and ground fill GF is disposed above the upper surface of the top wall 39. The circumscribing side wall portions 21 and 39 thus define a volume 26 which completely surrounds the side wall of the cellar and may serve to insulate the volume 13 against heat transfer in either direction with respect to the surrounding soil or ground formation. Extensions of the cellar floor 20 protrude beyond the circumscribing wall 15 and are sealingly connected to the circumscribing side wall 21, as illustrated. The extensions of the cellar wall 20 are sloped to provide drainage for any water which may enter the volume 26. Portions 27 and 28 of the extension of floor 20 are disposed between vertical wall portions 16 and 22 and slope towards the center of wall 16 at which a drainage opening 35 is provided permitting water to pass therethrough down the sloping upper surface 20A of the cellar wall 20 to a central drainage opening 40 therein. Portions 29 and 30 between vertical wall portions 17 and 23 slope toward the center thereof to cause water to flow through the drainage opening 36 and down the cellar floor 20. Notations 31, 32 and 33, 34 refer to respective sloping wall portions between the end wall portions of the circumscribing cellar wall 15 and the outer wall 21 and each is sloped to a drainage location, preferably located in the center of the walls 18 and 19.

Also provided in FIG. 1 is a downward extension 21A of the circumscribing side wall 21 which protrudes a distance beyond the floor 20, preferably below the water line of the soil surrounding the building so that ground water, once that contained within the confines of the extension 21A has evaporated, will not be forced upwardly against the cellar floor 20 and therefore may not cause the leakage of water through the cellar floor. Portions 25E and 25F of the circumscribing extension 21A of the outer wall 21 are shown in FIG. 1 and are joined by respective side wall portions thereof. Notation F refers to stone or gravel fill of conventional structure and material which is generally disposed beneath the basement floor of a building and it is noted that such fill may include insulating material such as a cellular plastic or a foamed concrete poured in situ thereon to prevent the loss of heat through the cellar floor.

A number of suitable materials may be made to fill the annular volume 26 surrounding the circumscribing basement wall 15. These materials may include sand or other fine particulate such as cellular plastic, cellular plastic blocks filling said volume, cellular plastic material expanded in situ within the volume 26, fibrous insulation material such as glass wool or mineral fibers; plastic bags containing shredded newspaper, cellular plastic, mineral wool, etc., which are packed within the volume 26 or combinations of such materials. A preferable material may comprise beach sand which may be poured or packed into the volume 26. Suitable removable filter or screen elements may also be provided in the drainage passageways 35, 36, 37 and 38 in the respective portions of the cellar wall 15.

For the conventional one or two family home or dwelling, the width of the plenum defining insulating material containing volume 26 may vary from about two feet to about six feet and will be a function of the location and latitude of the building site, soil conditions, climate, etc. An average width of four feet or slightly less will suffice for most temperate zone locations which experience freezing temperatures during most of the winter months. This width will also provide an insulating plenum which can accommodate a small amount of water therein from water vapor or leakage through small cracks in the concrete walls from the surrounding soil. Conventional steel reinforcements for the concrete walls may also be provided.

I claim:

1. A building structure comprising in combination:

a building having a foundation portion including a subterranean vertical inner wall circumscribing a subterranean volume, such as a cellar, a floor disposed across said circumscribing inner wall and connected thereto near the bottom thereof, an outer wall circumscribing and spaced-apart from said inner wall and extending to at least the depth of said inner wall beneath the surface of the ground, said outer wall defining an annular volume with said inner wall, and a circumscribing top wall joining said outer and inner walls to enclose said annular volume, and a solid, air-entrapping insulating material disposed within and substantially filling said annular volume for retarding the transfer of heat between the volume located inwardly of said inner wall and the soil exterior of said outer wall.

2. A building structure in accordance with claim 1 wherein said solid air-entrapping insulating material filling said volume between said outer and inner walls comprises a particulate material.

3. A building structure in accordance with claim 2 wherein said particulate material comprises sand.

4. A building structure in accordance with claim 2 wherein said particulate material comprises fine gravel.

5. A building structure in accordance with claim 1 wherein said solid air-entrapping insulating material disposed within said annular volume between said outer and inner walls comprises a cellular plastic material.

6. A building structure in accordance with claim 1 wherein said top wall between said outer and inner walls has its top surface substantially at the level of and parallel to the surface of the ground surrounding said building.

7. A building structure in accordance with claim 1 wherein said top wall between said outer and inner walls is disposed beneath the surface of the ground and soil covering the upper surface of said top wall to the level of the ground.

8. A building structure in accordance with claim 1 wherein the annular volume between said outer and inner walls is sealed with the exception of at least one passageway through said inner wall to said annular volume and located to permit drainage of any water which may penetrate through said annular volume.

9. A building structure in accordance with claim 1 including a bottom wall joining said outer and inner walls and extending completely around said inner wall, said bottom wall having an upper surface which is configured and sloped to a low point for drainage of liquid within said annular volume and a passageway through said inner wall at the low point of said sloped bottom wall to permit liquid collected thereat within said annular volume to flow to the volume interior of said inner wall.

10. A building structure in accordance with claim 1 wherein said outer and inner walls are shaped to define a plurality of wall portions which are at substantially right angles to each other and the bottom wall of each of said wall portions being sloped to define a low point therebetween and drainage means at each of said low points.

11. A building structure in accordance with claim 10 wherein said drainage means at each of said low points comprises a passageway through the inner wall portion of said building.

12. A building structure in accordance with claim 1 including an extension of at least one of said inner and outer wall portions circumscribing the foundation of said building and extending downwardly below the water line of the ground supporting the building defined by said building structure.

13. A building structure in accordance with claim 1 wherein said inner and outer walls defining said annular volume are spaced between two feet and six feet apart from each other.

14. A building structure in accordance with claim 1 wherein said inner and outer walls defining said annular volume are spaced between three feet and four feet apart from each other.

15. A method of insulating a building to reduce heat loss therefrom comprising:

providing an evacuated volume adjacent to and surrounding the cellar or basement walls of the building wherein said evacuated volume extends to at least below the frost line, disposing a solid, air-entrapping insulating material in said evacuated volume, which material is of such a characteristic as to prevent the circulation of air within said evacuated volume whereby heat will not easily be transferred through the walls of said cellar or basement.

16. A method in accordance with claim 15 including providing said solid air-entrapping insulating material as loose paper sealed in plastic bags and placing said paper filled bags within said evacuated volume in abutment with one another.

17. A method in accordance with claim 15 which includes lining the walls of said evacuated volume with a sealing means so as to seal same from moisture.

18. A method in accordance with claim 17 wherein the lining step is effected by providing a plastic sheet material against the walls of the evacuated volume.

19. A building structure comprising in combination:

a building having a foundation portion including a subterranean vertical inner wall circumscribing a subterranean volume such as a cellar, a floor disposed across said circumscribing inner wall and connected thereto near the bottom thereof, an outer wall circumscribing and spaced-apart from said inner wall and extending to at least the depth of said inner wall beneath the surface of the ground, said outer wall defining an annular volume with said inner wall, and a circumscribing top wall joining said outer and inner walls to enclose said annular volume, and a bottom wall joining said outer and inner walls and extending completely around said inner wall, said bottom wall having an upper surface which is configured and sloped to a low point for the drainage of liquid within said annular volume and a passageway through said inner wall at the low point of said sloped bottom wall to permit liquid collected thereat from within said annular volume to flow to the volume interior of said inner wall, and insulating material provided within said annular volume for retarding the transfer of heat between the volume inwardly of said inner wall and the soil exterior of said outer wall.

20. A building structure comprising in combination:

a building having a foundation portion including a subterranean vertical inner wall circumscribing a subterranean volume such as a cellar, a floor disposed across said circumscribing inner wall and connected thereto near the bottom thereof, an outer wall circumscribing and spaced-apart from said inner wall and extending to at least the depth of said inner wall beneath the surface of the ground, said outer wall defining an annular volume with said inner wall, and a circumscribing top wall joining said outer and inner walls to enclose said annular volume, said inner wall being shaped to define a plurality of wall portions which are substantially at right angles to each other, the bottom wall of each of said wall portions being sloped to define a low point therebetween and drainage means at each of said low points, said drainage means comprising a passageway through the inner wall portion of said building.

* * * * *